United States Patent [19]

Sullivan

[11] 4,281,434

[45] Aug. 4, 1981

[54] APPARATUS FOR CLEANING THE SURFACE OF A ROTATING ROLLER

[75] Inventor: Lawrence G. Sullivan, Halifax, England

[73] Assignee: Crosrol Limited, Halifax, England

[21] Appl. No.: 123,419

[22] Filed: Feb. 20, 1980

[30] Foreign Application Priority Data

Feb. 23, 1979 [GB] United Kingdom ..... 06454/79

[51] Int. Cl.[3] ..... D01H 11/00

[52] U.S. Cl. ..... 15/256.51; 15/256.53; 100/174; 165/91; 101/157; 165/91;

[58] Field of Search ..... 15/256.5, 256.51, 256.53, 15/308; 68/270; 100/174; 355/15 198/496;497;498

[56] References Cited

U.S. PATENT DOCUMENTS

| | | | |
|---|---|---|---|
| 3,183,541 | 5/1965 | Goyette | 198/497 X |
| 4,133,073 | 1/1979 | Marzoli | 15/256.51 X |
| 4,165,965 | 8/1979 | Bernardelli et al. | 355/15 X |

*Primary Examiner*—Chris K. Moore

*Attorney, Agent, or Firm*—Norbert P. Holler

[57] ABSTRACT

Apparatus for cleaning the surface of a rotating roller (1). First and second cleaning blades (8, 9) each have an edge extending axially across the surface of the roller and adjacent thereto, the edges being parallel and directed against the direction of rotation of the roller. The edge of the second blade (9) is disposed behind the edge of the first blade (8) relative to the direction of rotation. Means are provided for causing relative movement of the blades to reverse the disposition of the edges and cause the edge of the blade (9) to scrape that surface of the blade (8) which faces towards the roller. During such movement the blade (9) is moved so that its edge contacts the roller to keep a constant cleaning action. The edge of blade (8) scrapes the surface of blade (9) as the blades return to their original disposition.

7 Claims, 5 Drawing Figures

APPARATUS FOR CLEANING THE SURFACE OF A ROTATING ROLLER

This invention relates to apparatus for cleaning the surface of a rotating roller.

There are many industries where the surfaces of rollers need to be cleaned on a substantially continuous basis. For example, in the textile industry cotton and wool cards incorporate a series of processing rollers through which the fibres pass. Unwanted waste accumulates on the surfaces of certain of these rollers and in many instances the accumulated deposit is of a sticky nature. It is essential that the surfaces of such rollers are kept clean and various proposals have been put forward for effecting such cleaning. Obviously the carding industry is not the only one where cleaning of a roller surface is necessary and the invention thus finds general application.

Many known forms of roller surface cleaning involve apparatus comprising a scraper blade which is located to have an edge extending axially across the surface of the roller and either adjacent thereto or in contact therewith. The presence of the scraper blade removes at least part of any deposit from the roller surface and the deposit so removed may be allowed to fall into a collector or may be blown or sucked from the cleaning region of the roller. It is commonly found with such scraper blades that a deposit of material can accumulate on the edge of the blade itself and interfere with the continuing efficiency of the cleaning. Proposals have been put forward for cleaning such edges, but none has been entirely satisfactory. It is an object of the present invention to provide an arrangement that will solve this problem.

According to the invention apparatus for cleaning the surface of a rotating roller comprises first and second cleaning blades each having an edge extending axially across the surface of the roller and adjacent thereto, the two blades being mounted so that their edges are substantially parallel and directed against the direction of rotation of the roller with the edge of the second blade disposed behind the edge of the first blade relative to that direction, and means for causing relative movement of the blades to reverse the disposition of the edges and to cause the edge of one of the blades to scrape a surface of the other during such reversal.

In operation the first blade normally acts to scrape material from the surface of the roller and thus clean that surface. During that operation material accumulates on the edge of the first blade and in order to clean this the deposition of the edges of the two blades are periodically reversed. The scraping action of the edge of one of the blades on the surface of the other during this reversal removes the accumulated deposit and the blades can then be returned to their original disposition. The reversal operation may be effected as often as necessary to obtain the required cleaning effect. In a preferred form of operation the reversal of the disposition of the edges is followed almost immediately by a return of the blades to the normal positions, this action being repeated at required intervals. In an alternative the reversal may be effected and a given period of time allowed to elapse before the blades are caused to return to their normal position. After a further delay another reversal occurs and the cycle is repeated.

Preferably the second blade is fixed and the first blade is movable to reverse the disposition of the edges.

Conveniently the blades are disposed so that during reversal of the disposition of the edges the edge of the second blade scrapes that surface of the first blade which faces towards the roller, and so that during return to the original disposition of the edges the edge of the first blade scrapes that surface of the second blade which faces away from the roller.

Preferably the first blade is more rigid than the second blade and the blades are disposed so that as the first blade moves out of contact with the roller that blade deflects the second blade to force the edge thereof into contact with the roller. This ensures that the cleaning action on the roller is substantially continuous, a feature that is particularly important in preventing the accumulation of waste on rollers in the textile carding operation.

In order that the invention may be better understood a specific embodiment thereof will now be described by way of example with reference to the accompanying drawings in which.

Figure 1:
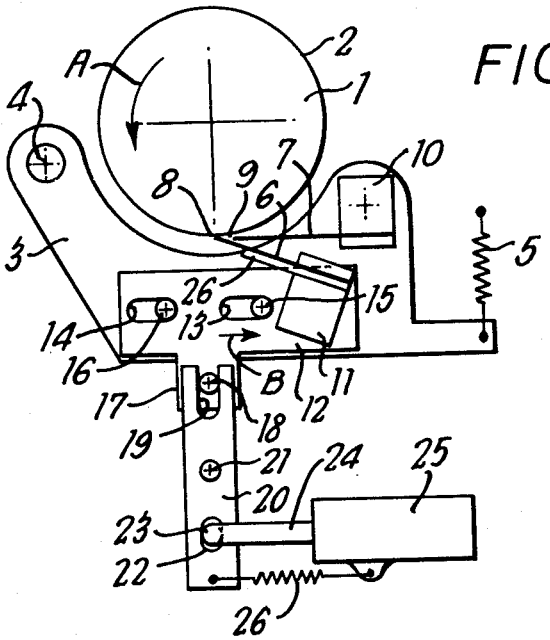
FIGS. 1 and 2 are end elevations of a first embodiment of apparatus according to the invention in two alternative positions.
Figure 2:
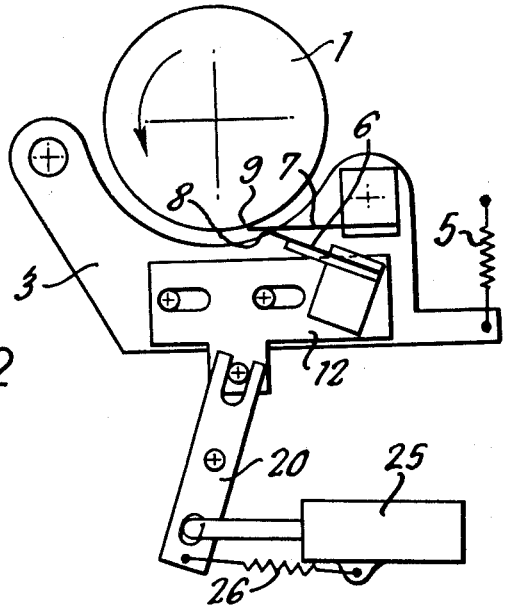

Referring to FIGS. 1 and 2 these show a roller 1 having a cylindrical surface 2 that requires constant cleaning. The roller may, for example, be any roller of a textile carding machine or of any other form of apparatus. In the textile carding context the roller may in particular be one of a pair of crush rolls located in the web transfer path between the breaker carding cylinder and the finisher carding cylinder of a duo-card, the second of the crush rolls being mounted directly above the roller 1. In this context the upper one of the crush rollers will also have a cleaning arrangement as described and this may be of identical form to the arrangement shown in the drawing but in an inverted position.

The cleaning apparatus comprises a carrier 3 which is pivotally mounted on a support (not shown) about an axis 4 and which is biased bowards the surface of the roller by a tension spring 5 anchored at one end to the support and at the other end to the carrier 3. The carrier has mounted thereon first and second blades 6 and 7 having respective edges 8 and 9 which are substantially parallel, lie adjacent to the surface of the roller and are directed against the direction of rotation of the roller, that direction being indicated by an arrow A in FIGS. 1 and 2. The edge 9 of the second blade 7 is disposed behind the edge 8 of the first blade 6 relative to the direction of rotation. The second blade 7 is mounted in a fixed holder 10 which is secured to the carrier 3.

The first blade 6 is mounted in a holder 11 which is secured to a plate 12 which is mounted on the carrier 3 for sliding movement in the direction of the arrow B. It will be understood that a carrier similar to the carrier 3 is positioned at the opposite axial end of the roller and that the opposite axial ends of the blades 6 and 7 are mounted on that other carrier 3 in a manner identical to that described.

The plate 12 is formed with two guide slots 13, 14 which engage pins 15 and 16 respectively secured to the carrier 3. A downward projection 17 from the plate 12 carries a pin 18 which is slidably engageable in a slot 19 formed in one end of a lever 20 pivoted on the support about an axis 21. Towards the other end of the lever 20 there is formed a slot 22 in which engages a pin 23 carried at the end of a piston rod 24 secured to a piston movable in an air cylinder 25 which is secured to the support. A tension spring 26 connects the lever 20 to the air cylinder and acts to bias the lever 20, plate 12 and blade 6 into the position shown in FIG. 1.

FIG. 1 shows the position of the apparatus during normal operation. It will be seen that due to the action of the spring 5, the edge 8 of the first blade 6 lies in contact with the surface of the roller and as the roller rotates the blade 6 thus scrapes deposits from the surface of the roller. Those deposits are removed by the waste extraction system of the card. After operation for a certain period of time, it will be found that the edge 8 of the first blade 6 has an accumulated deposit thereon which needs to be removed for effective cleaning to continue. This removal is effected by admitting air to the air cylinder 25 to pivot the lever 20 clockwise and drive the plate 12 to its right hand limit position as shown in FIG. 2. It will be seen that during this movement the edge 9 of the second blade 7 scrapes that surface of the blade 6 which faces towards the roller, so removing deposited material from the blade 6. When the blade 6 reaches its limit position it will be noted that the disposition of the edges 8 and 9 of the blades 6 and 7 have been reversed so that the edge 8 is now disposed behind the edge 9 relative to the direction of rotation of the roller. The first blade 6 may be formed with a relatively rigid stiffening member 26 while the second blade 7 is relatively flexible and the blades are disposed so that as the first blade moves out of contact with the roller that blade deflects the second blade 7 to force the edge 9 of the second blade into contact with the roller. This ensures that the cleaning action on the roller is substantially continuous.

After movement of the position shown in FIG. 2 air is released from the cylinder and the tension spring 26 returns the parts to the positions shown in FIG. 1. During this return movement the edge 8 of the first blade 6 scrapes that surface of the second blade 7 which faces away from the roller so that the second blade is also cleaned. This operation may be performed with whatever frequency is desired.

Figure 3:
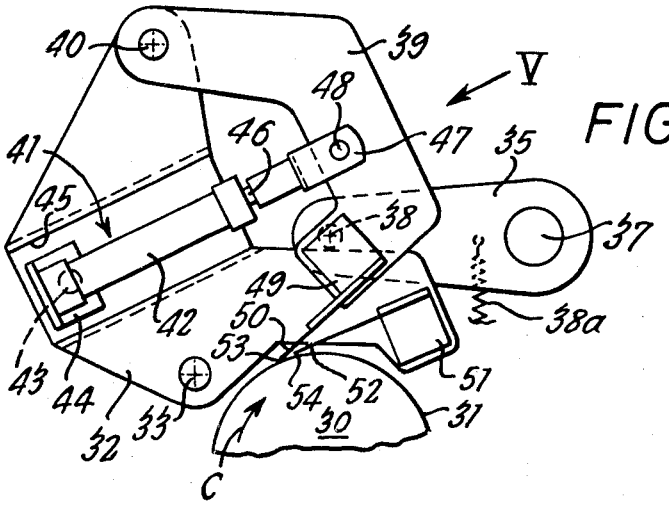
FIGS. 3 and 4 are end elevations of a second embodiment of apparatus according to the invention in two alternative positions.
Figure 4:
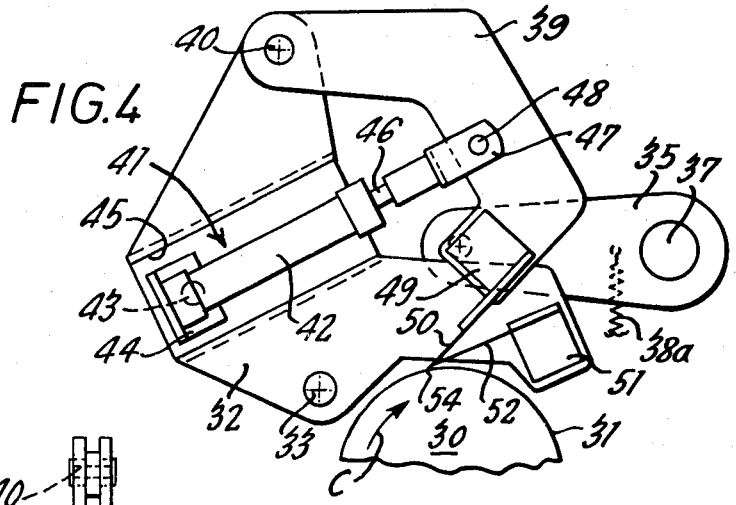
Figure 5:
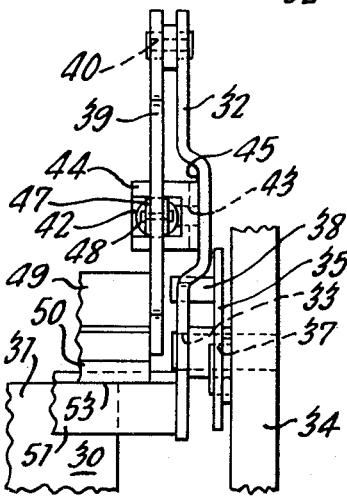
FIG. 5 is an elevation in the direction of the arrow V in FIG. 3.

Referring now to FIGS. 3 to 5 there is shown a roller 30 having a surface 31 that requires constant cleaning. The roller again may be any roller of a textile carding machine or any other form of apparatus and in particular may be one of a pair of crush rolls located in the centre of a duo-card. In such arrangement there will also be a lower crush roller mounted directly below the roller 31, the lower roller having a cleaning arrangement of identical form to that shown in FIG. 3, but in an inverted arrangement. The cleaning apparatus comprises a carrier 32 pivotally mounted about an axis 33 to the frame 34 of the card. An arm 35 is also pivoted on the frame 34 about a pivot 37 and carries a pin 38 bearing on a surface of the carrier 32. A tension spring 38*a* is secured to the arm 35 and to a point (not shown) on the frame and acts through the pin 38 to bias the carrier 32 towards the surface of the roller.

An arm 39 is pivotally mounted on the carrier 32 about a pivot 40 and is movable about the pivot by an air cylinder assembly shown generally as 41. The assembly comprises a cylinder 42 pivotally secured at 43 to a mounting 44 located in a well 45 of the carrier 3. Within the cylinder is a piston carrying a piston rod 46 secured to a clevis 47 pivotally secured to the arm 39 by a pivot pin 48.

The arm 39 carries a first blade holder 49 carrying a first blade 50. The carrier 32 carries a second blade holder 51 supporting a second blade 52. The two blades have respective edges 53 and 54 which are substantially parallel, lie adjacent to the surface of the roller and are directed against the direction of rotation of the roller, that direction being indicated by the arrow C in FIGS. 3 and 4. It will be understood that an arrangement similar to that described is positioned at the opposite axial end of the roller 30 and that the opposite axial ends of the blade holders 49 and 51 are mounted on the other carrier in a manner identical to that described. The blades 50 and 52 thus extend the full axial length of the roller.

FIG. 3 shows the position of the apparatus during normal operation, the edge 53 of the first blade 50 being held in contact with the surface of the roller 30 due to the action of the tension spring 38*a*. As the roller rotates, the edge 53 thus scrapes deposits from the surface of the roller. When it is desired to clean the blade 50 air is admitted to the air cylinder 42 so pivoting the arm 39 about the pivot 40 to the position shown in FIG. 4. During this movement the edge 54 of the second blade 52 scrapes that surface of the blade 50 which faces towards the roller 30, so removing deposited material from the blade 50. When the blade 50 reaches its limit position it will be noticed that the disposition of the edges 53 and 54 of the blades 50 and 52 have been reversed, so that the edge 53 is now disposed behind the edge 54 relative to the direction of rotation of the roller. In this position, the second blade 52 (which is made more flexible than the first blade 50) has been deflected so that the edge 54 lies in contact with the roller surface, thus ensuring that the cleaning action on the roller is substantially continuous.

When it is desired to return to normal operation air is released from the cylinder 42, so returning the arm 39 to the original position, during which movement the edge 53 of the first blade 50 scrapes that surface of the second blade 52 which faces away from the roller, so that the second blade is also cleaned.

While two particular arrangements for mounting and controlling the scraper blades have been described it will be appreciated that there are many other possible methods of mounting the blades and of controlling their relative positions. Furthermore the means for causing relative movement of the blades may take any one of a number of different forms, and may include power means other than an air cylinder. The blades may be mounted to contact the roller at any required point on its periphery.

I claim:

1. Apparatus for cleaning the surface of a rotating roller comprising first and second cleaning blades each having an edge extending axially across the surface of said roller and adjacent thereto, said two blades being mounted so that their said edges are substantially parallel and directed against the direction of rotation of said roller with said edge of said second blade disposed behind said edge of said first blade relative to said direction, and means for causing relative movement of said blades to reverse the disposition of said edges and to cause said edge of one of said blades to scrape a surface of the other of said blades during such reversal.

2. Apparatus according to claim 1 in which said second blade is fixed and said first blade is movable to reverse the disposition of said edges.

3. Apparatus according to claim 1 in which said blades are disposed so that during reversal of the disposition of said edges said edge of said second blade scrapes that surface of said first blade which faces towards said roller.

4. Apparatus according to any one of the preceding claims in which said blades are disposed so that during return to the original disposition of said edges said edge of said first blade scrapes that surface of said second blade which faces away from said roller.

5. Apparatus according to claim 1 in which said edge of said first blade normally lies in contact with said surface of said roller.

6. Apparatus according to claim 5 in which said blades are disposed so that during reversal of the disposition of said edges said edge of said first blade moves out of contact with said roller and contacts said second blade to force said edge of said second blade into contact with said roller.

7. Apparatus according to claim 1 in which said blades are mounted on a common carrier which is biased to hold said blades in their required dispositions relative to said roller.

* * * * *